US006145522A

United States Patent [19]

Ko

[11] Patent Number: 6,145,522

[45] Date of Patent: Nov. 14, 2000

[54] OPENING MECHANISM OF QUADRUPLE COLLAPSIBLE UMBRELLAS

[76] Inventor: Chin Sung Ko, No. 27-1, Lane 188, Sec. 3, Chin Mar Road, Changhua City, Taiwan

[21] Appl. No.: 09/345,965

[22] Filed: Jul. 1, 1999

[51] Int. Cl.[7] ..... A45B 25/16; A45B 19/08

[52] U.S. Cl. ..... 135/24; 135/25.4; 135/38

[58] Field of Search ..... 135/38, 39, 28, 135/25.1, 25.4, 37, 22, 24, 15.1

[56] References Cited

U.S. PATENT DOCUMENTS 5,791,359 8/1998 Lin et al. ..... 135/24
5,803,102 9/1998 Ko ..... 135/24
5,806,545 9/1998 Ko ..... 135/24
6,016,822 1/2000 Lin et al. ..... 135/24

*Primary Examiner*—Daniel P. Stodola
*Assistant Examiner*—Erica B. Harris
*Attorney, Agent, or Firm*—Rosenberg, Klein & Lee

[57] ABSTRACT

An opening mechanism of quadruple collapsible umbrellas, wherein the main improvements are two independent pulling ropes governing the movement of a runner and a stretcher system as well as the motion of the tubular elements of the umbrella stick. These improvements further include a hollow plug disposed in the umbrella stick, against the upper and the lower face of which plug two individual springs are respectively seated to provide sufficient resilient forces. A locating spring and a locating pin are arranged to prevent inadvertent triggering, which may cause damages to the umbrella.

3 Claims, 3 Drawing Sheets

OPENING MECHANISM OF QUADRUPLE COLLAPSIBLE UMBRELLAS

BACKGROUND OF THE INVENTION

Conventional automatic opening mechanisms used in a collapsible umbrella primarily use a single pulling rope and a single spring seated in the umbrella stick to govern the operation of opening and closing umbrellas. Due to the length of the rope, it often leads to malfunction when the opening mechanism is activated, resulting in immovable umbrella stretcher systems. Because of the limitation of rope's length such design can only be applied to a triple or less collapsible umbrella. It can not provide sufficient resilient forces for a quadruple collapsible umbrella. Besides, conventional automatic opening mechanisms do not have means to prevent unintentional triggering. As people inadvertently touch the trigger of the opening mechanism after an umbrella is opened the pulling rope may tangle with springs in the umbrella stick. This will lead to serious damages. This is a major deficiency of conventional opening mechanisms.

In view of the aforesaid problem, the primary object of the invention is to provide an improved opening mechanism used in a quadruple collapsible umbrella, which mechanism uses two pulling ropes and two springs to govern the opening and closing of an umbrella. Thus the invention can provide a multiple collapsible umbrella having enhanced performance.

Another object of the invention is to provide an improved opening mechanism used in a quadruple collapsible umbrella, in which a locating spring, in conjunction with a locating pin in the umbrella handle, is seated in the umbrella stick to prevent an inadvertent triggering of the opening mechanism, which may cause damages to an umbrella.

Now the structure and the features of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
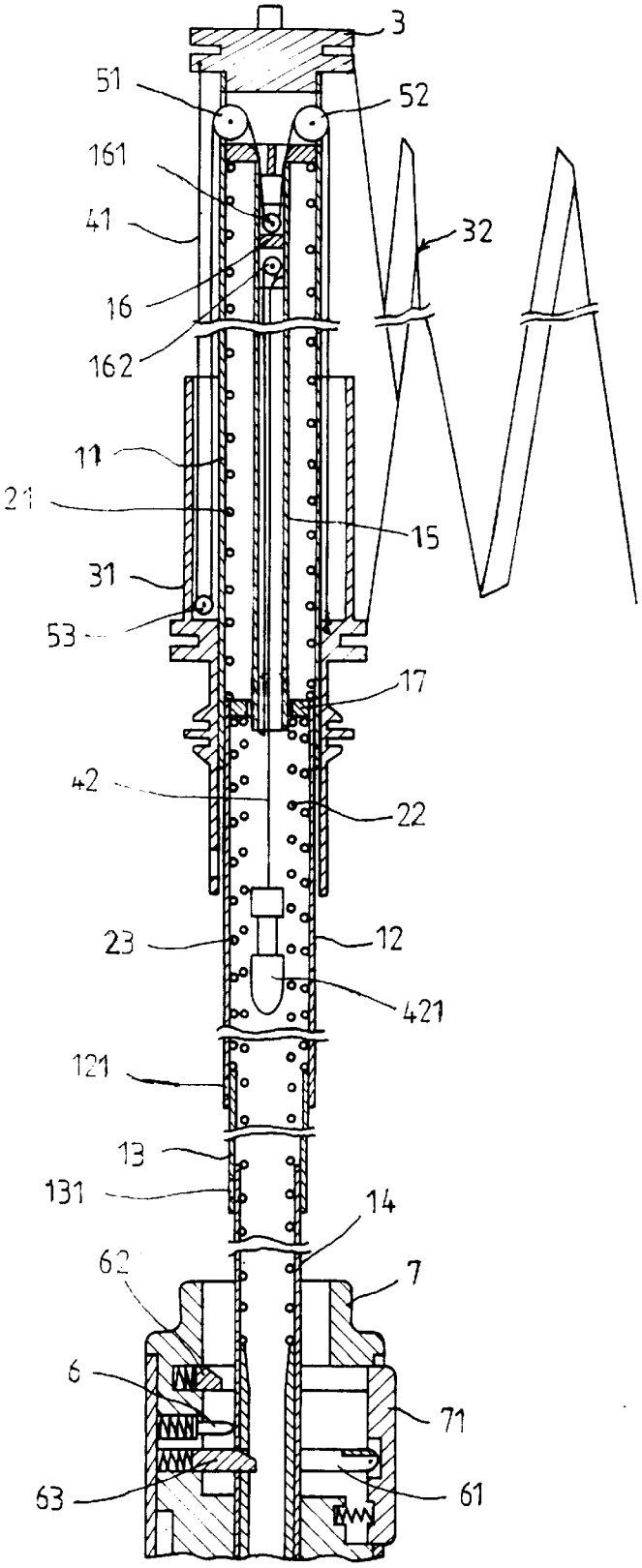
FIG. 1 is a cross sectional view showing a collapsible umbrella having an opening mechanism according to the invention in a closed state.

As shown in the accompanying drawings, the opening mechanism according to the present invention includes an umbrella stick (1), which is composed of a first tube (14), a second tube (13), a third tube (12) and a fourth tube (11). An upper grooved element (3) is mounted on the top of the umbrella stick (1) and a runner (31) slides over the outer surface of the umbrella stick (1). The upper grooved element (3) and the runner (31) are respectively pivotally connected to the inmost ends of umbrella stretchers or ribs of the umbrella stretcher system (32). The lower end of the umbrella stick (1) extends into an umbrella handle (7). The umbrella handle (7) is provided with a button (71) that actuates an upper stopper (62) and a lower stopper (61) to lock the members of the opening mechanism in position. In this way, a quadruple collapsible umbrella is constructed.

The structure is similar to that of a conventional umbrella and thus it will not be detailed here.

The present invention is featured by a hollow plug (17) that mounts on the top of the third tube (12). An upper spring (21) and a lower spring (22) are respectively seated in the upper portion and the lower portion of the umbrella stick (1) and separated from each other by the plug (17). In the third tube (12) there is a locating spring (23), the lower end of which presses against the top of the second tube (13). An inner copper tube (15) lies in the upper portion of the umbrella stick (1). In the hollow interior of the inner copper tube (15) is a slide block (16), which abuts against an upper pulley (161) and a lower pulley (162) respectively on its upper and lower face. The fourth tube (11) is provided on two sides near the upper end with a side pulley (51, 52). Furthermore, another pulley (53) is arranged in the runner (31) on the same side as the pulley (51).

According to the invention, the opening mechanism further comprises an upper pulling rope (41) and a lower pulling rope (42). The upper pulling rope (41) is attached to the upper grooved element (3) at one end and downward extends the other end toward the pulley (53) in the runner (31). Then the upper pulling rope (41) goes around the pulley (53) and continues to extend toward the side pulley (51). The upper pulling rope (41) makes a U-turn around the pulley (51) and downward extends into the inner copper tube (15). The upper pulling rope (41) makes another U-turn at the upper pulley (161) and extends in an opposite direction toward the side pulley (52). The upper pulling rope (41) makes half a turn around the side pulley (52) and extends in a downward direction and is finally tied to the runner (31). The lower pulling rope (42) is tied at the lower end to the top of a bullet-shaped weight (421) and extends at the other end toward the lower pulley (162). The lower pulling rope (42) winds around the lower pulley (162) a half turn and then extends downward and is eventually fastened to the lower end of the inner copper tube (15).

Figure 2:
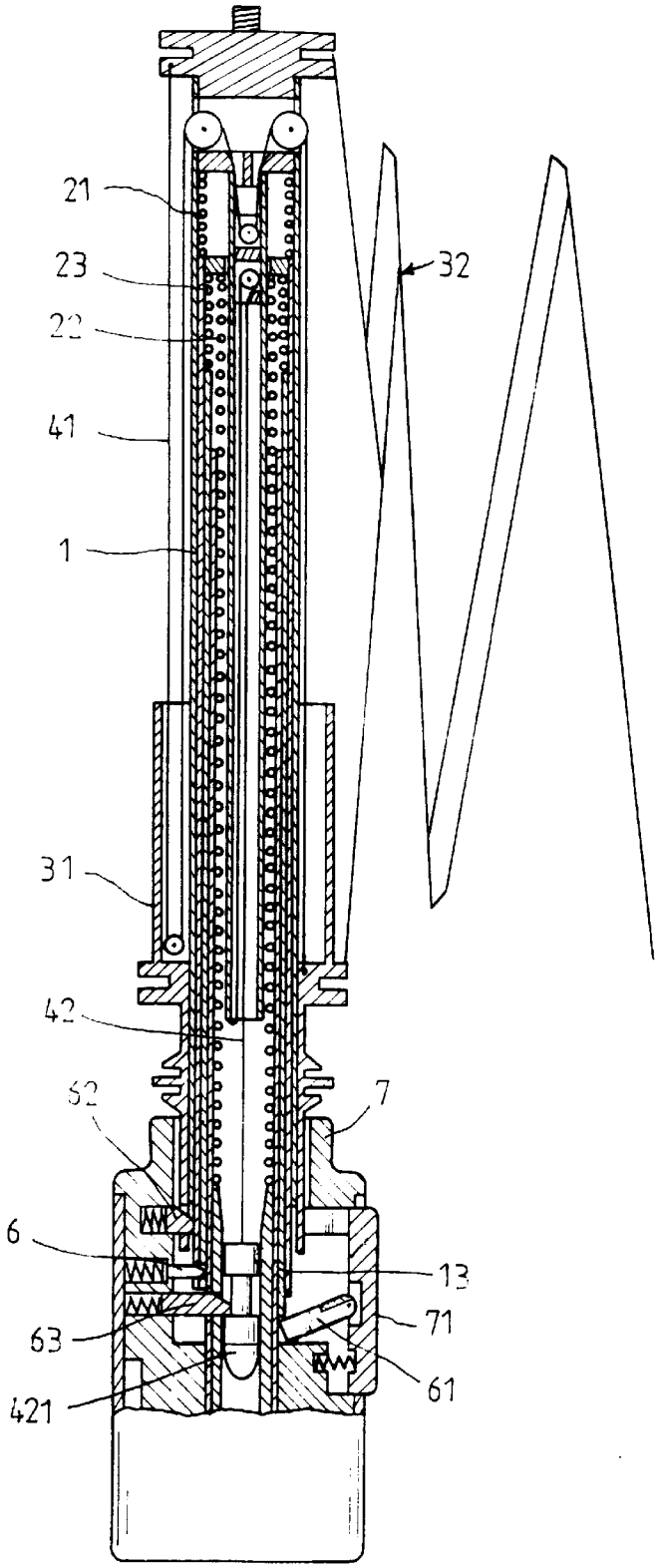
FIG. 2 is a cross sectional view showing the umbrella of FIG. 1 in a collapsed state.
Figure 3:
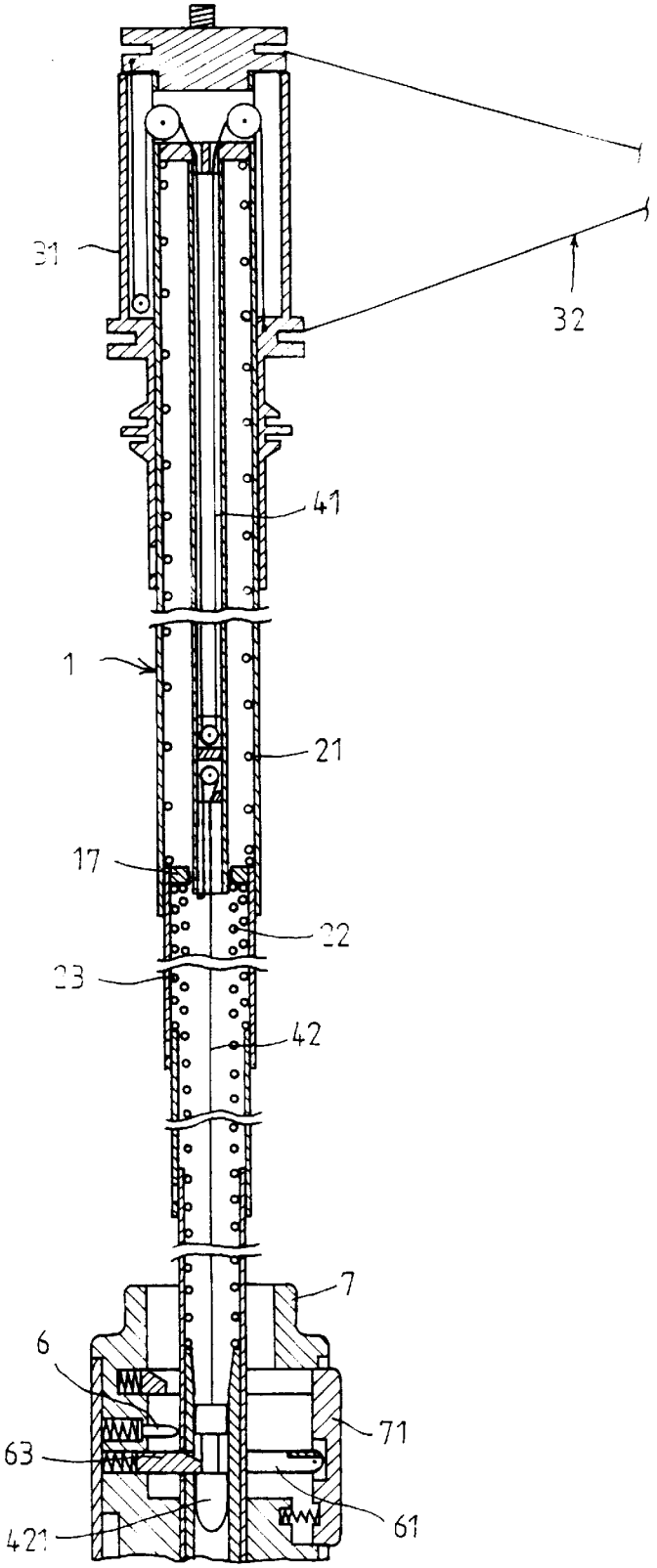
FIG. 3 is a cross sectional view indicating the umbrella of FIG. 1 in an open state.

When the umbrella stick (1) is pressed inwards along a longitudinal direction as shown in FIG. 2, the umbrella tubes retract to a point where the bullet-shaped weight (421) is held by a lock block (63) and the runner (31) is secured by the upper stopper (62). The second tube (13) and the third tube (12) are respectively provided on the lower portion with an opening (131, 121). When these umbrella tubes retract to a point where two openings (131) and (121) are in alignment with each other, a roundhead locating pin (6) locks the umbrella tubes in position. Then the lower stopper (61) is biased downward by the lower end of the second tube (13). When in use, people first press down the button (71) to make the runner (31) escape from the retention of the upper stopper (62). The resilient forces of the upper spring (21) and the lower spring (22), in conjunction with the pulling force of the upper rope (41), make the runner (31) move upwardly until the umbrella stretcher system (32) fully spreads out the canopy as shown in FIG. 3. Then the lower stopper (61) restores to its original horizontal position. When users depress the button (71) again, the lock block (63) is urged to move so that the bullet-shaped weight (421) is released. Impelled by the lower pulling rope (42) and the umbrella stretcher system (32), the umbrella closes as shown in FIG. 1.

The opening mechanism according to the invention can open and close an umbrella smoothly due to two independent springs and pulling ropes, which provide sufficient forces to open a closed quadruple collapsible umbrella without the shortcomings of entangled or stuck ropes.

In case an inadvertent triggering makes the upper stopper (62) separate from the runner (31) while a quadruple collapsible umbrella of a prior art is folded up and placed in a handbag, the lower end of the second tube (13) will not abut against the lower stopper (61) any more. Then the lower stopper (61) might go back to its original horizontal position but the umbrella stretcher system does not spread out. If users are not aware of this situation and take it out of the handbag, another depression of the button (71) might lead to entangled springs and pulling ropes because the umbrella has not been opened and the bullet-shaped weight (421) has been free from retention, resulting in malfunctions or even damages to the umbrella. This problem has gotten remedies in an opening mechanism according to the invention. In the inventive mechanism, when an inadvertent triggering happens and the runner (31) escapes from retention, the forces exerted by the locating spring (23) and the locating pin (6) still hold the second tube (13) in position and the lower stopper (61) is kept in a slant state. Another depression of the button (71) will not cause the bullet-shaped weight (421) to separate from the lock block (63). Thus it can get rid of the deficiency of a conventional mechanism. Furthermore, the locating pin (6) described above has a roundhead end, which has a limited retention force and will not affect the opening operation of an umbrella.

What is claimed is:

1. An opening mechanism used in quadruple collapsible umbrellas comprising an umbrella stick that is composed of a first tube, a second tube, a third tube and a fourth tube; an upper grooved element mounted on the top of the umbrella stick; a runner sliding over the umbrella stick; an umbrella stretcher system; and an umbrella handle enclosing the lower end of the umbrella stick;

said upper grooved element and said runner being respectively pivotally connected to the inmost ends of umbrella stretchers or ribs of the umbrella stretcher system, said umbrella handle being provided with a button that actuates an upper stopper and a lower stopper to keep members of the opening mechanism in position;

characterized in that disposed in the third tube are a hollow plug that divides the inner space of the umbrella stick into an upper and a lower portion respectively housing an upper spring and a lower spring, and a locating spring with the lower end thereof pressing against the top of the second tube;

characterized in that an inner copper tube lies in the upper portion of the umbrella stick, in the hollow interior of said inner copper tube is a slide block that abuts against an upper pulley and a lower pulley respectively on its upper and lower face;

and in that said fourth tube is provided on two sides of the upper portion thereof with a side pulley and another pulley is arranged in the runner on the same side as said side pulley, characterized in that there are an upper rope and a lower rope arranged in the umbrella stick, said upper rope being attached on one end to said upper grooved element and downwardly extending the other end toward said pulley of the runner and making half a turn around the pulley and then extending in a reversal direction to pass by one of said two side pulleys and then getting into the inner copper tube and continuing to extend toward the upper pulley and making a U-turn around the upper pulley and then passing by the other of said two side pulleys and being finally fastened to the runner, said lower rope being fixed on one end to the top of a bullet-shaped weight and upwardly extending the other end thereof to pass by said lower pulley and further extending downwardly and finally being tied to the lower end of said inner copper tube.

2. The opening mechanism used in quadruple collapsible umbrellas as claimed in claim 1, wherein said second tube and said third tube are respectively provided with an opening on the lower portion at a location where the two openings will align with each other when the umbrella is collapsed so that a roundhead pin disposed in the umbrella handle can extend into the openings to secure umbrella tubes in position while the lower end of said second tube impels the lower stopper to incline downward, and characterized in that when the button is depressed to separate the upper stopper from the runner, the resilient forces of the upper and the lower spring as well as the pulling force of the upper rope bring the runner to move upwards until the umbrella stretcher system fully spreads out the canopy and then the lower stopper goes back to its original horizontal position; and in that when the button is depressed the second time the lock block is activated to discharge the bullet-shaped weight and then with the aid of the umbrella stretcher system and the lower rope the umbrella is closed.

3. The opening mechanism used in quadruple collapsible umbrellas as claimed in claim 1, wherein in case an inadvertent triggering happens said runner might be free from the retention while a locating spring and a locating pin still hold the second tube in position and thus the lower stopper is kept in an inclined state, which will prevent the bullet-shaped weight from separation from the lock block as the button is depressed once again.

* * * * *